US005991925A

United States Patent [19]

Wu

[11] Patent Number: 5,991,925

[45] Date of Patent: Nov. 30, 1999

[54] VEST HAVING LOCATING PADS WITH FASTENING STRIPS FOR ATTACHING ACCESSORIES THERETO

[76] Inventor: Bo Kun Wu, No. 391, Hsintu Road, Tainan City, Taiwan

[21] Appl. No.: 09/189,123

[22] Filed: Nov. 10, 1998

[51] Int. Cl.[6] ..... A41D 1/04

[52] U.S. Cl. ..... 2/102; 2/94; 2/247; 2/920; 224/645; 224/646; 224/901.4; 224/901.8; 224/911; 224/931

[58] Field of Search ..... 2/2.5, 920, 69, 2/93, 94, 85, 247, 108, 102, 455, 463, 462, 250; 224/645, 646, 901.4, 901.8, 911, 931, 243

[56] References Cited

U.S. PATENT DOCUMENTS

| | | | |
|---|---|---|---|
| 4,106,121 | 8/1978 | Belson | 2/102 |
| 4,637,075 | 1/1987 | Ingrisano et al. | 2/94 |
| 5,060,314 | 10/1991 | Lewis | 2/2.5 |
| 5,465,425 | 11/1995 | Crispin | 2/247 |
| 5,567,055 | 10/1996 | Smith | 383/38 |
| 5,617,582 | 4/1997 | Burwell | 2/102 |
| 5,632,426 | 5/1997 | Beletsky et al. | 224/243 |
| 5,644,794 | 7/1997 | Hull et al. | 2/102 |
| 5,692,237 | 12/1997 | Bennett | 2/93 |
| 5,692,661 | 12/1997 | Kellerman | 224/648 |
| 5,724,707 | 3/1998 | Kirk et al. | 2/210 |
| 5,754,982 | 5/1998 | Gainer | 2/2.5 |
| 5,797,140 | 8/1998 | Davis et al. | 2/2.5 |

*Primary Examiner*—John J. Calvert
*Assistant Examiner*—Tejash D Patel
*Attorney, Agent, or Firm*—Pro-Techtor International Services

[57] ABSTRACT

A bulletproof vest includes a vest body, the vest body having a plurality of locating pads at front and back panels thereof and a plurality of fabric fastening strips respectively extended from the locating pads for securing things to the locating pads, a plurality of detachable ammunition pouches respectively fastened to the locating pads of the vest body by hook and loop materials, the detachable ammunition pouches each having a plurality of insertion slots for the insertion of the fabric fastening strips, a pistol holster detachably fastened to one locating pad at the front panel of the vest body by hook and loop materials to hold a pistol, and a radio transceiver holder detachably fastened to one locating pad at the back panel of the vest body by hook and loop materials to hold a radio transceiver.

11 Claims, 13 Drawing Sheets

VEST HAVING LOCATING PADS WITH FASTENING STRIPS FOR ATTACHING ACCESSORIES THERETO

BACKGROUND OF THE INVENTION

The present invention relates to a bulletproof vest, and more particularly to such a bulletproof vest which has a plurality of locating pads and retaining tapes for holding ammunition pouches, pistol holster, radio transceiver, name tag, etc., by means of hook and loop materials.

A bulletproof jacket is made so that a bullet cannot go through. Conventional bulletproof jackets are simply designed to protect the user against bullets, and have no holder means for holding things such as ammunition pouches, pistol, radio transceiver, etc. It is difficult for a policeman or solder to carry a lot of equipment when wearing a bulletproof jacket.

SUMMARY OF THE INVENTION

The present invention has been accomplished under the circumstances in view. It is one object of the present invention to provide a bulletproof vest which has means to hold a variety of personal items and equipment. It is another object of the present invention to provide a bulletproof vest which has means to hold a variety of personal items and equipment without hindering the movement of the user. According to one aspect of the present invention, the bulletproof vest comprises a vest body, the vest body having a plurality of locating pads at front and back panels thereof and a plurality of fabric fastening strips respectively extended from the locating pads for securing things to the locating pads, a plurality of detachable ammunition pouches respectively fastened to the locating pads of the vest body by hook and loop materials, the detachable ammunition pouches each having a plurality of insertion slots for the insertion of the fabric fastening strips, a pistol holster detachably fastened to one locating pad at the front panel of the vest body by hook and loop materials to hold a pistol, and a radio transceiver holder detachably fastened to one locating pad at the back panel of the vest body by hook and loop materials to hold a radio transceiver. According to another aspect of the present invention, the vest body further comprises a pocket at its front side on the middle, a zip fastener operated to close/open the pocket, and a metal plate received in the pocket to the user's heart area against bullets. According to still another aspect of the present invention, the vest body further comprises a thigh guard receiver at the bottom side of its front panel, and a thigh guard fastened to the thigh guard receiver to protect the lower part of the user's body.

DETAILED DESCRIPTION OF THE PREFERRED EMBODIMENT

Referring to the annexed drawings in detail, a bulletproof vest in accordance with the present invention is generally comprised of a vest body 1 having a plurality of T-shaped fabric fastening strips 10 for securing a variety of accessories by hook and loop materials. The vest body 1 is divided into a front panel for covering the front side of the body, a back panel for covering the back side of the body, and a shoulder panel connected between the front panel and the back panel for covering the shoulder area of the body. The front panel, the back panel and the shoulder panel are made in integrity. The back panel defines a neck for receiving the neck of the body.

The vest body 1 comprises at its shoulder panel two sets of fixed partition strips 111 arranged at two opposite lateral sides, two shoulder pads 11 fastened to the partition strips 111 and defining with the partition strips 111 a plurality of insertion holes over the shoulder area for receiving the shoulder straps of different devices. The shoulder pads 11 are arranged at two opposite lateral sides in the shoulder area of the vest body 1, each having one end fixed fastened to the vest body 1 and an opposite end detachably secured to the corresponding partition strips 111 by hook and loop materials.

Figure 1:
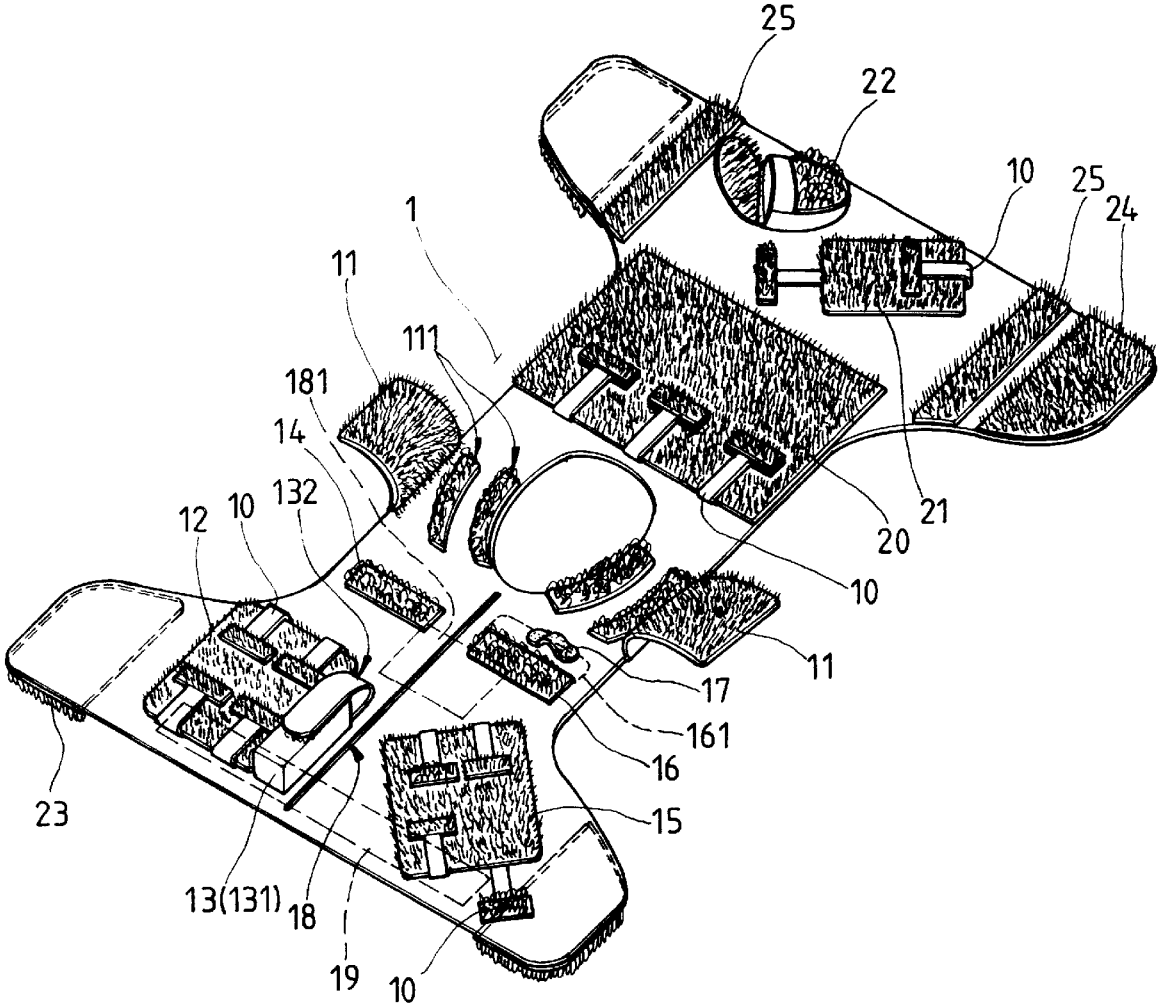
FIG. 1 is an extended out view of a vest body for a garment according to the present invention.
Figure 4:
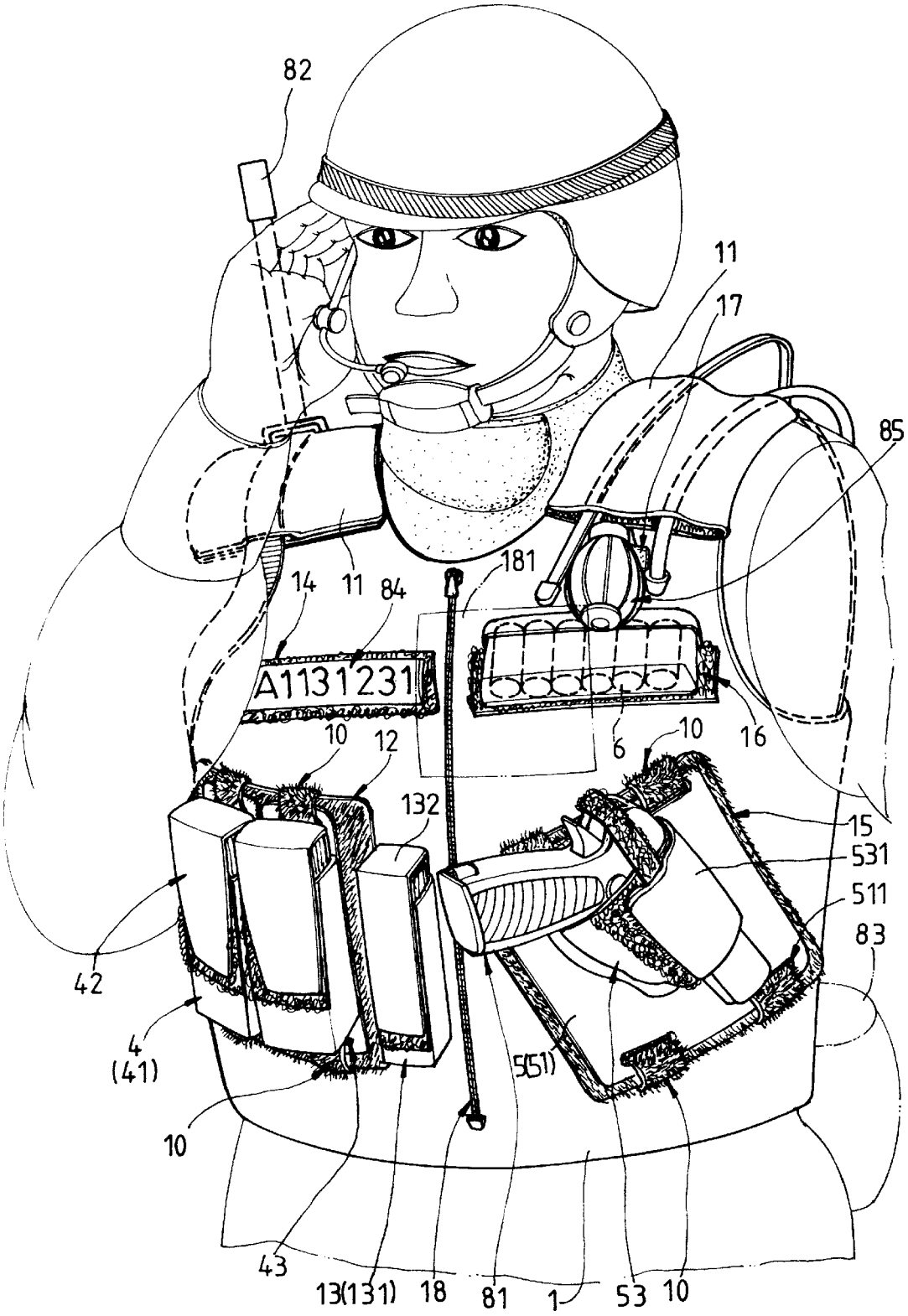
FIG. 4 is a front view showing the bulletproof vest worn on the body, different devices fastened to the bulletproof vest according to the present invention.

At the left side of the front panel of the vest body 1, there is provided a first locating pad 12, a fixed ammunition pouch 13 at one lateral side of the first locating pad 12, and a first transverse retaining tape 14 above the first locating pad 12 and the ammunition pouch 13 (see FIGS. 1 and 4). The first locating pad 12 is fixedly mounted with a number of the aforesaid T-shaped fabric fastening strips 10. The ammunition pouch 13 comprises a pouch body 131, and a cover flap 132 (see FIG. 4) detachably closed on the pouch body 131. The pouch body 131 is fixedly mounted with a hook (or loop) tape 1311 at its front side, and the cover flap 132 is fixedly mounted with a loop (or hook) tape 1321 for fastening to the hook (or loop) tape 1311 at the pouch body 131 (see also FIG. 7).

Figure 10:
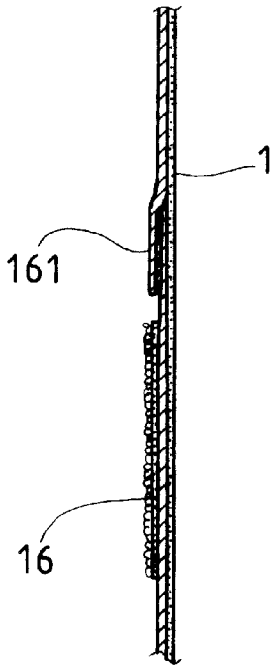
FIG. 10 is a side view of a part of the present invention, showing the second transverse retaining tape and the retaining flap fastened to the vest body.

At the right side of the front panel of the vest body 1, there is provided a second locating pad 15, a second transverse retaining tape 16 above the second locating pad 15, a retaining flap 161 above the second transverse retaining tape 16, and a loop 17 above the retaining flap 161 (see FIGS. 1 and 10). The second locating pad 15 is fixedly mounted with a number of the aforesaid T-shaped fabric fastening strips 10.

Figure 5:
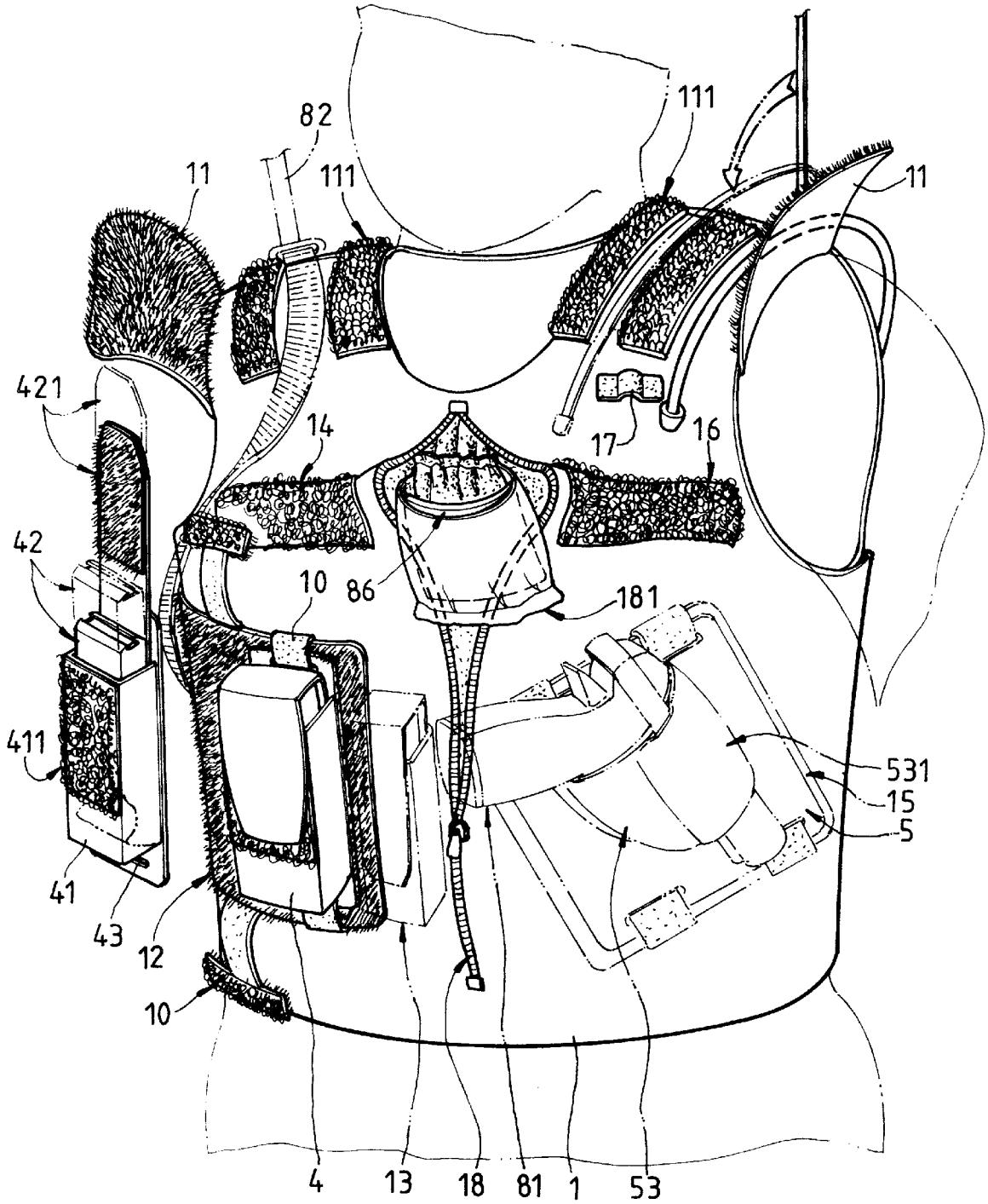
FIG. 5 is a front view showing the installation of the present invention.

On the middle of the front panel of the vest body 1, there is provided a zip fastener 18 operated to close/open a pocket 181, which is provided to hold a metal plate 86 that protects the heart area against bullets (see FIGS. 1, 4 and 5).

Figure 14:
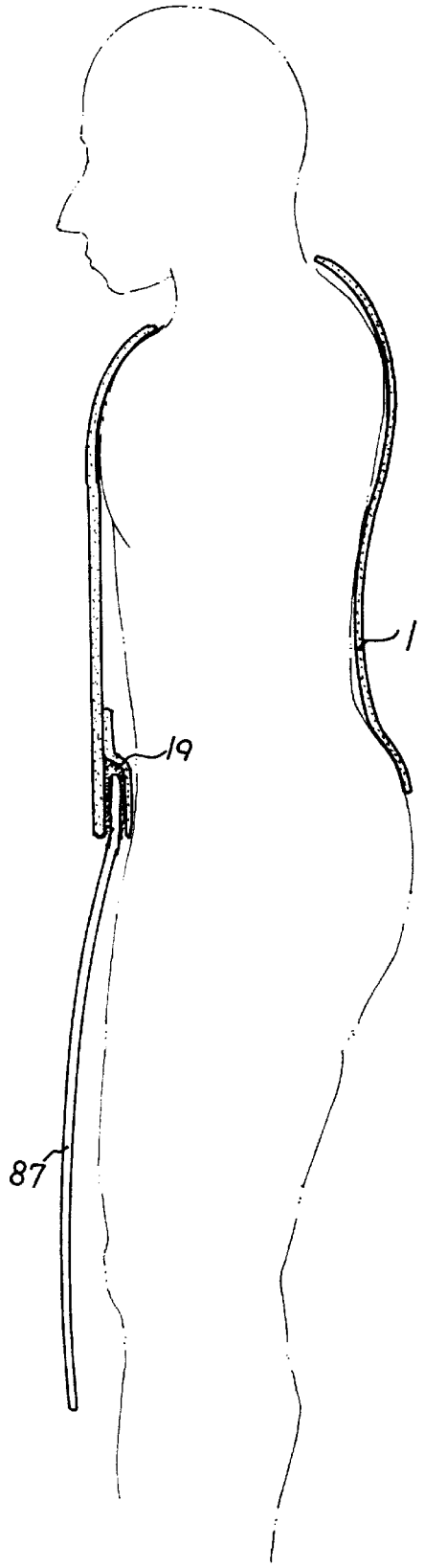
FIG. 14 is a schematic drawing showing a thigh guard fastened to the vest body according to the present invention.

At the bottom side of the front panel of the vest body 1, there is provided a thigh guard receiver 19, which is designed to hold an anti-bullet thigh guard 87 (see FIGS. 1 and 14).

At the back panel of the vest body 1, there is provided a third locating pad 20 transversely disposed at an upper elevation, a fourth locating pad 21 and a handcuff case 22 obliquely disposed at a lower elevation below the third locating pad 20. The third locating pad 20 and the fourth locating pad 21 are respectively fixedly mounted with a number of the aforesaid T-shaped fabric fastening strips 10 (see FIGS. 1 and 6).

The vest body 1 further comprises two first bottom fastening strips 23 bilaterally extended from the bottom side of its front panel in reversed directions, and two second bottom fastening strips 24 bilaterally extended from the bottom side of its back panel in reversed directions for connection to the first bottom fastening strips 23 by hook and loop materials to secure the vest body 1 to the user's body (see FIGS. 1 and 15), and two longitudinal retaining strips 25 bilaterally disposed at the bottom side of its back panel.

Figure 2:
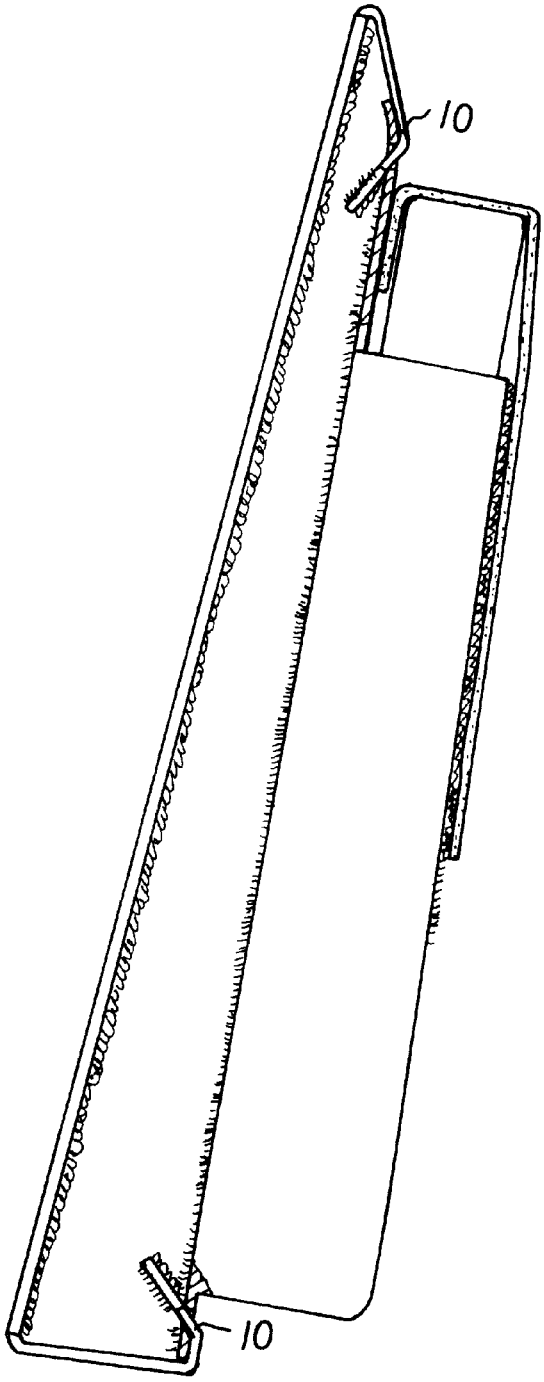
FIG. 2 is a side view of a part of the present invention, showing an ammunition pouch connected between T-shaped fabric fastening strips.
Figure 3:
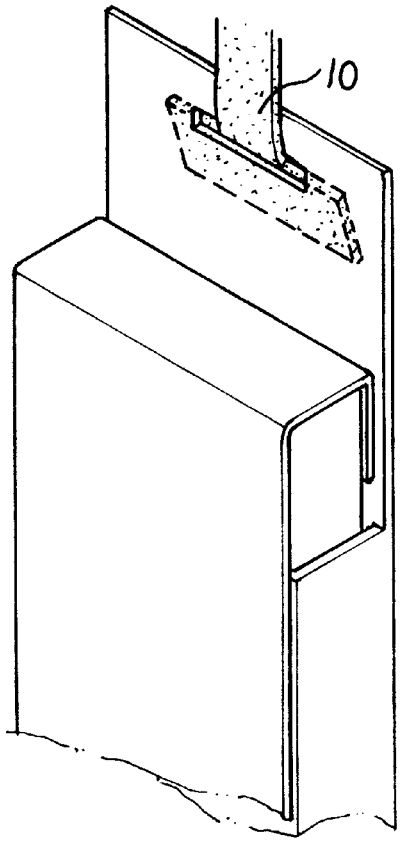
FIG. 3 is a perspective view of a part of the present invention, showing an ammunition pouch fastened to a T-shaped fabric fastening strip.

The free ends of the T-shaped fabric fastening strips 10 are inserted in respective through holes on devices attached to the locating pads 12,15,20,21, and then secured to the respective locating pads 12,15,20,21 by hook and loop materials to hold the attached devices in place (see FIGS. 2 and 3). According to the present preferred embodiment, the locating pads 12,15,20,21 are respectively fixedly mounted with a hook tape, and the T-shaped free ends of the T-shaped fabric fastening strips 10 are respectively fixedly mounted with a loop tape for fastening to the hook tape at the respective locating pad. Further, the fabric fastening strips 10 can be made having any of a variety of shapes if desired.

Referring to Figures from 4 through 7, a plurality of detachable ammunition pouches 4 are attached to the first locating pad 12, and secured in place by the fabric fastening strips 10 at the first locating pad 12. The detachable ammunition pouches 4 each comprise a pouch body 41, and a cover flap 42. The pouch body 41 is fixedly mounted with a hook tape 411 at its front side. The cover flap 12 is fixedly mounted with a loop tape 421, which is fastened to the hook tape 411 at the pouch body 41 when the cover flap 12 is closed on the pouch body 41. The pouch body 41 further comprises two transverse insertion slots 43 near top and bottom sides thereof for the insertion of the respective T-shaped fabric fastening strips 10.

Referring to FIGS. 1, 9, 16, 17 and 18, a pistol holster 5 is attached to the second locating pad 15 and secured in place by the respective T-shaped fabric fastening strips 10 to hold a pistol 81. The pistol holster 5 comprises a base panel 51 having a plurality of insertion slots 511 respectively fastened to the respective T-shaped fabric fastening strips 10 at the second locating pad 15, a pocket 53 provided at the base panel 51, which receives the pistol 81, an elastic band 532 provided inside the pocket 53 to hold the pistol 81 in place, a cover flap 531 fixedly fastened to one lateral side of the pocket 53, the cover flap 531 having its one side wall fixedly mounted with a loop tape for fastening to a hook tape at the outside wall of the pocket 53, a retaining strip 52 having one end fixedly connected to the base panel 51 near its top side, a socket (of a snap) 521 at the fixed end of the retaining strip 52, and a harness detachable connected between the retaining strip 52 and the cover flap 531 to hold down the pistol 81 in the pocket 53, which harness comprising a first strip 54, the first strip 54 having one end fixedly mounted with a stud (of a snap) 541, which is fastened to the socket 521 at the fixed end of the retaining strip 52, and an opposite end detachable retained between the pocket 53 and the cover flap 531 by hook and loop materials, and a second strip 543 raised from a middle part of the first strip 54 and detachably fastened to the free end of the retaining strip 52 by hook and loop materials.

Figure 11:
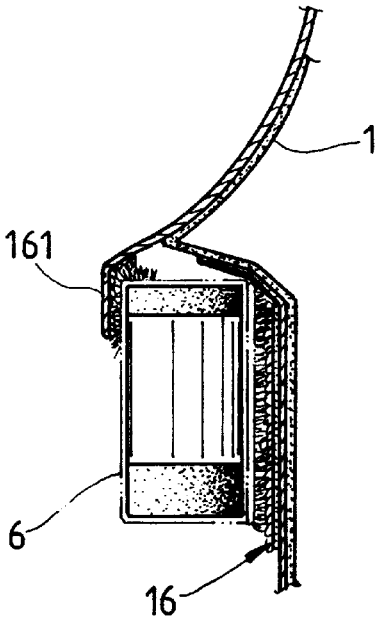
FIG. 11 is a side view of a part of the present invention, showing a detachable ammunition pouch fastened to the second transverse retaining tape and the retaining flap.

Referring to FIGS. 4, 10 and 11, a detachable ammunition pouch 6 is detachably fastened to the second transverse retaining tape 16 and secured in place by the retaining flap 161. Hook and loop materials are used and respectively installed in the detachable ammunition pouch 6, the second transverse retaining tape 16 and the retaining flap 161, enabling the detachable ammunition pouch 6 to be detachably retained between the second transverse retaining tape 16 and the retaining flap 161.

Figure 6:
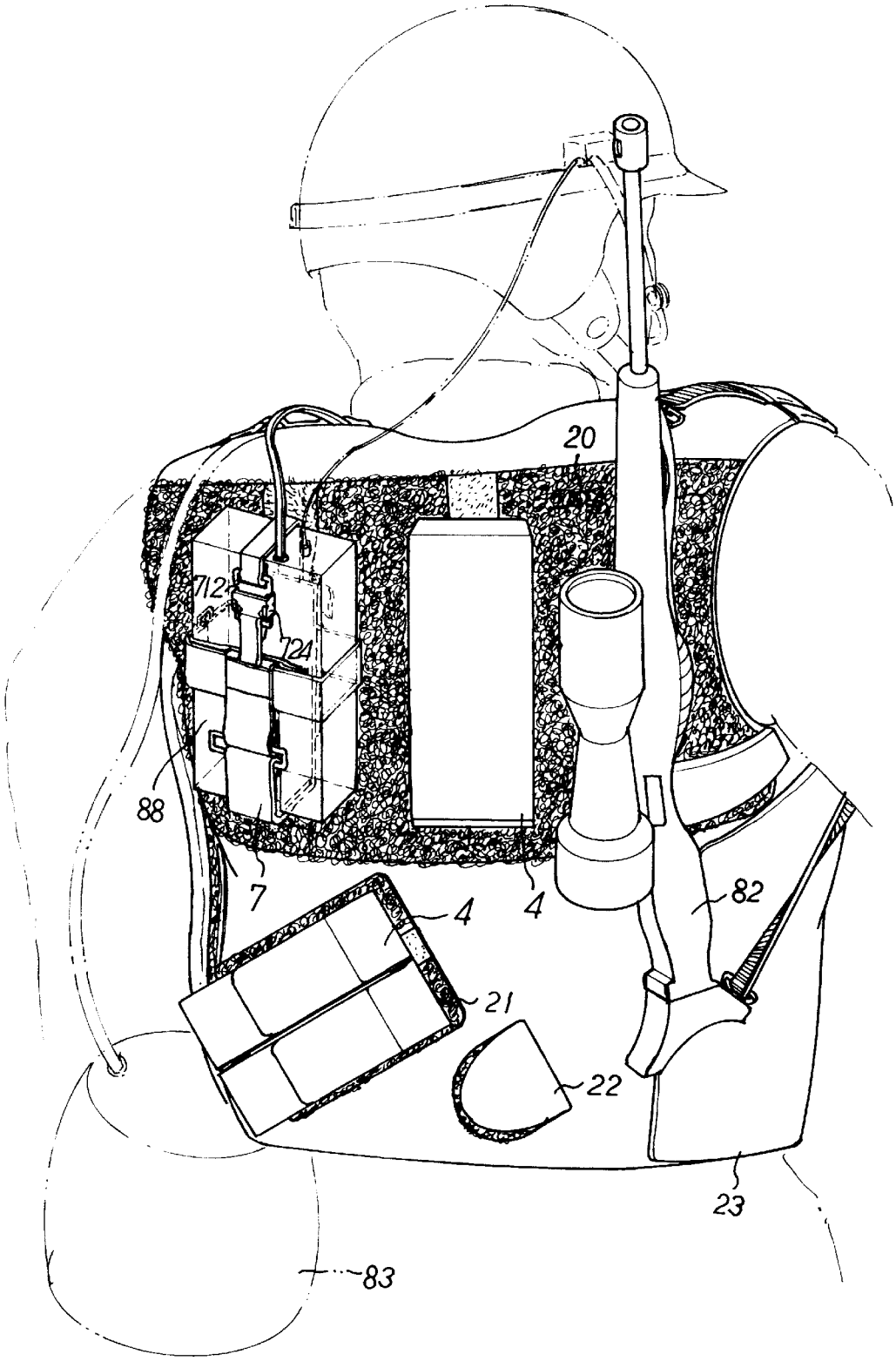
FIG. 6 is a back side view showing the installation of the present invention.
Figure 12:
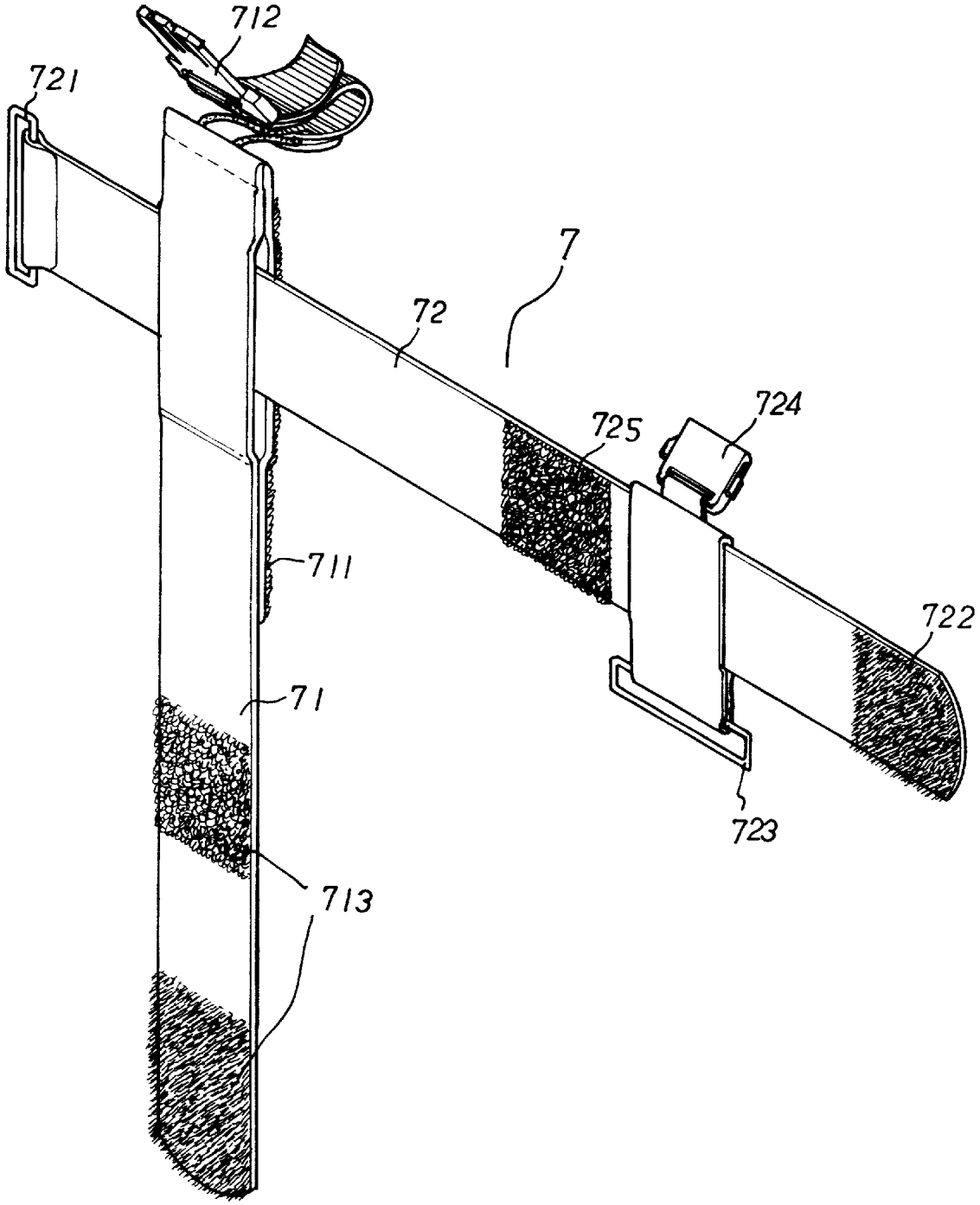
FIG. 12 is an extended out view of a radio transceiver holder according to the present invention.
Figure 13:
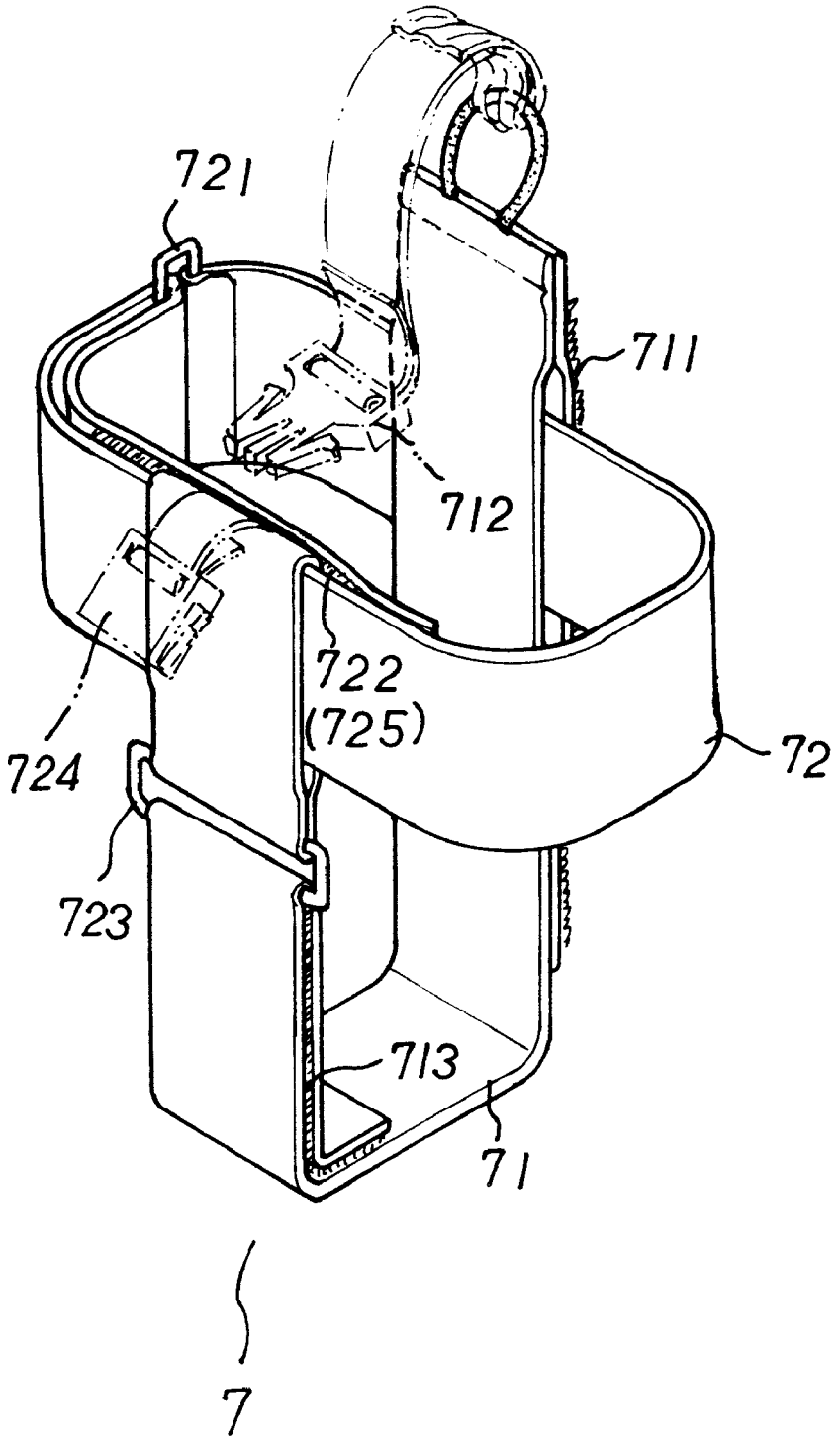
FIG. 13 is a perspective view showing the radio transceiver holder set up according to the present invention.

Referring to FIGS. 6, 12 and 13, a radio transceiver holder 7 is provided, and detachably fastened to the third locating pad 20 at the back panel of the vest body 1. The radio transceiver holder 7 comprises a longitudinal strap 71, and a transverse strap 72. The longitudinal strap 71 comprises a loop tape 711 at its back side for fastening to the hook tape at the third locating pad 20, hook and loop materials (a hook tape and a loop tape) 713 longitudinally spaced at its front side, and an elastic band with a male fastening element 712 (of a quick release hook) at its top end. The transverse strap 72 is inserted through a transverse hole near the top end of the longitudinal strap 71, having a first belt loop 721 at its front end, a hook tape 722 at the front side of its rear end, a loop tape 725 at the front side near the middle, a female fastening element 724 (of a quick release hook) and a second belt loop 723 spaced between the first hook tape 722 and the second hook tape 725 and vertically extended in reversed directions. The rear end of the transverse strap 72 is inserted through the first belt loop 721 and then turned back, enabling the hook tape 722 to be fastened to the loop tape 725, then the bottom end of the longitudinal strap 71 is inserted through the second belt loop 723 and then turned back, enabling the hook tape of the hook and loop materials 713 to be fastened to the loop tape thereof. When a radio transceiver 88 is inserted into the receiving space defined within the radio transceiver holder 7, the quick release hook is fastened up, i.e., the male fastening element 712 is fastened to the female fastening element 724 to secure the installed radio transceiver 88 in place.

Referring to FIGS. 1, 4, 5 and 6, the shoulder pads 11 are provided to hold a rifle 82 and a canteen 83. The shoulder straps of the rifle 82 and the canteen 83 are respectively hung in the insertion holes defined between the fixed partition strips 111 and the shoulder pads 11.

Figure 7:
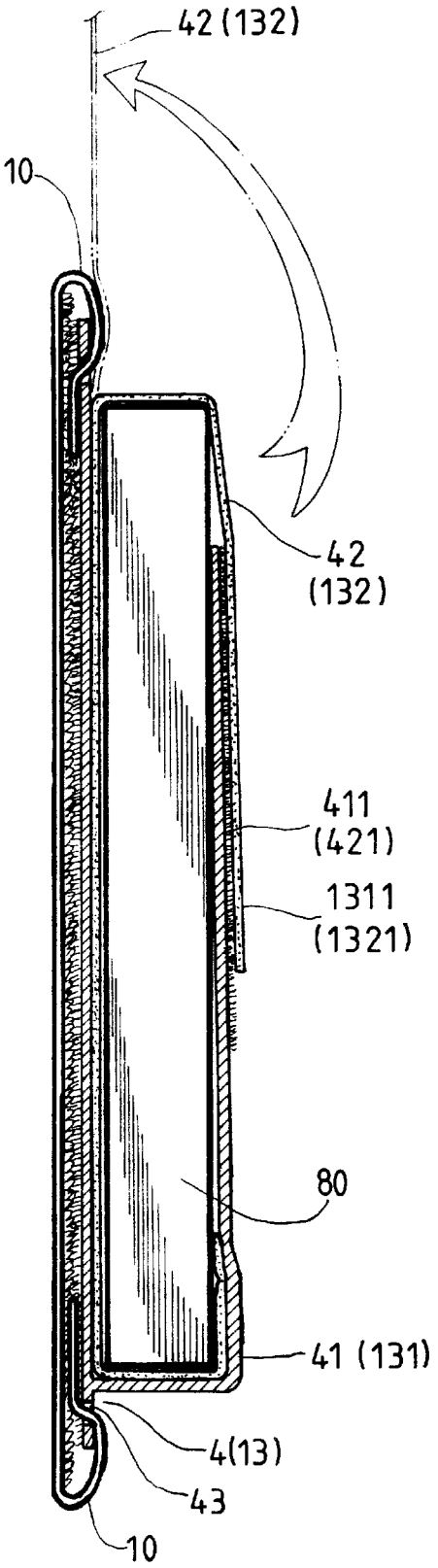
FIG. 7 is a side view showing the installation of a detachable ammunition pouch according to the present invention.
Figure 8:
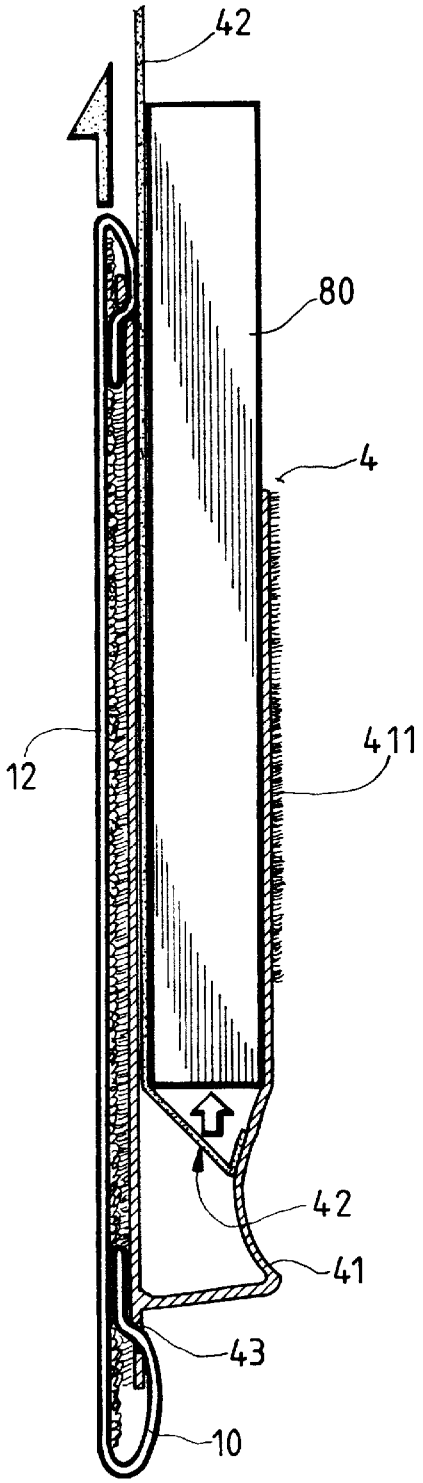
FIG. 8 is similar to FIG. 7 but showing the ammunition pouch opened, the cartridge box removed from the ammunition pouch.
Figure 9:
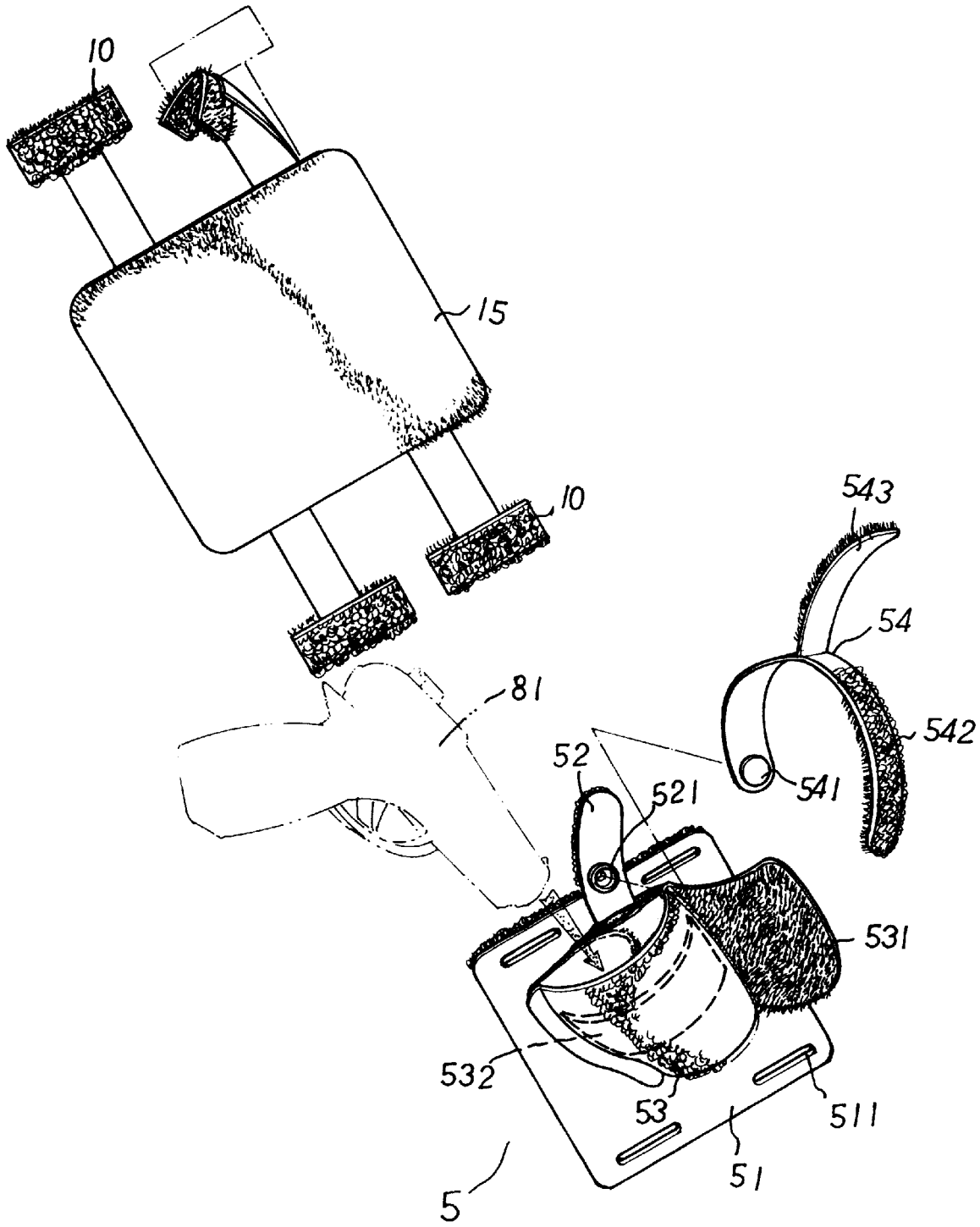
FIG. 9 is an exploded view of a part of the present invention, showing the structure of the pistol holster.
Figure 18:
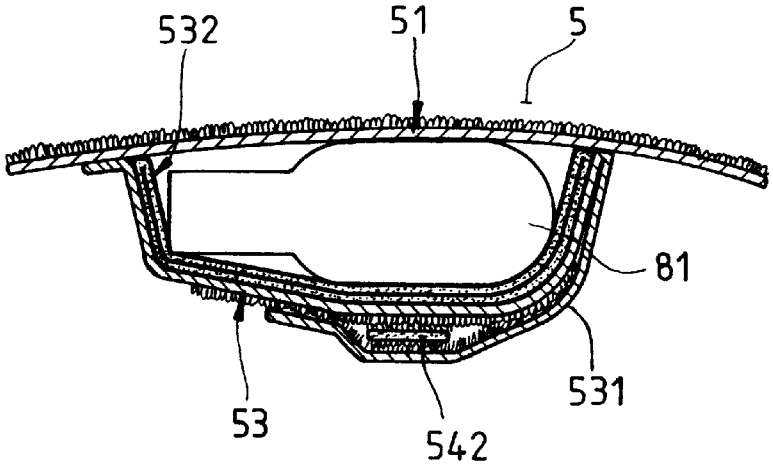
FIG. 18 is a bottom view of FIG. 16.

Referring to FIGS. 4 and 7, two detachable ammunition pouches 4 are attached to the first locating pad 12, and secured in place by the respective T-shaped fabric fastening strips 10.

Referring to FIGS. 4 and 7, the fixed ammunition pouch 13 is fixedly provided at one lateral side of the first locating pad 12 to hold a cartridge box 80.

Referring to FIG. 4, a name tag 84 is fastened to the first transverse retaining tape 14 by hook and loop materials.

Referring to FIG. 4, the pistol holster 5 is attached to the second locating pad 15 and secured in place by the respective T-shaped fabric fastening strips 10 to hold a pistol 81.

Referring to FIGS. 4, 10 and 11, the detachable ammunition pouch 6 is detachably fastened to the second transverse retaining tape 16, and secured in place by the retaining flap 161.

Referring to FIG. 4, a grenade 85 is hung on the loop 17 above the second transverse retaining tape 16.

Referring to FIGS. 4 and 5, when the zip fastener 18 is operated to open the pocket 181, a metal plate 86 is mounted in the pocket 181 to protect the heart area against bullet.

Referring to FIG. 14, an anti-bullet thigh guard 87 is secured to the thigh guard receiver 19 to protect the lower part of the body.

Referring to FIG. 6, a radio transceiver 88 is mounted in the radio transceiver holder 7 at the third locating pad 20.

Referring to FIG. 6, two detachable ammunition pouches 4 are attached to the fourth locating pad 21, and secured in place by the respective T-shaped fabric fastening strips 10.

Figure 15:
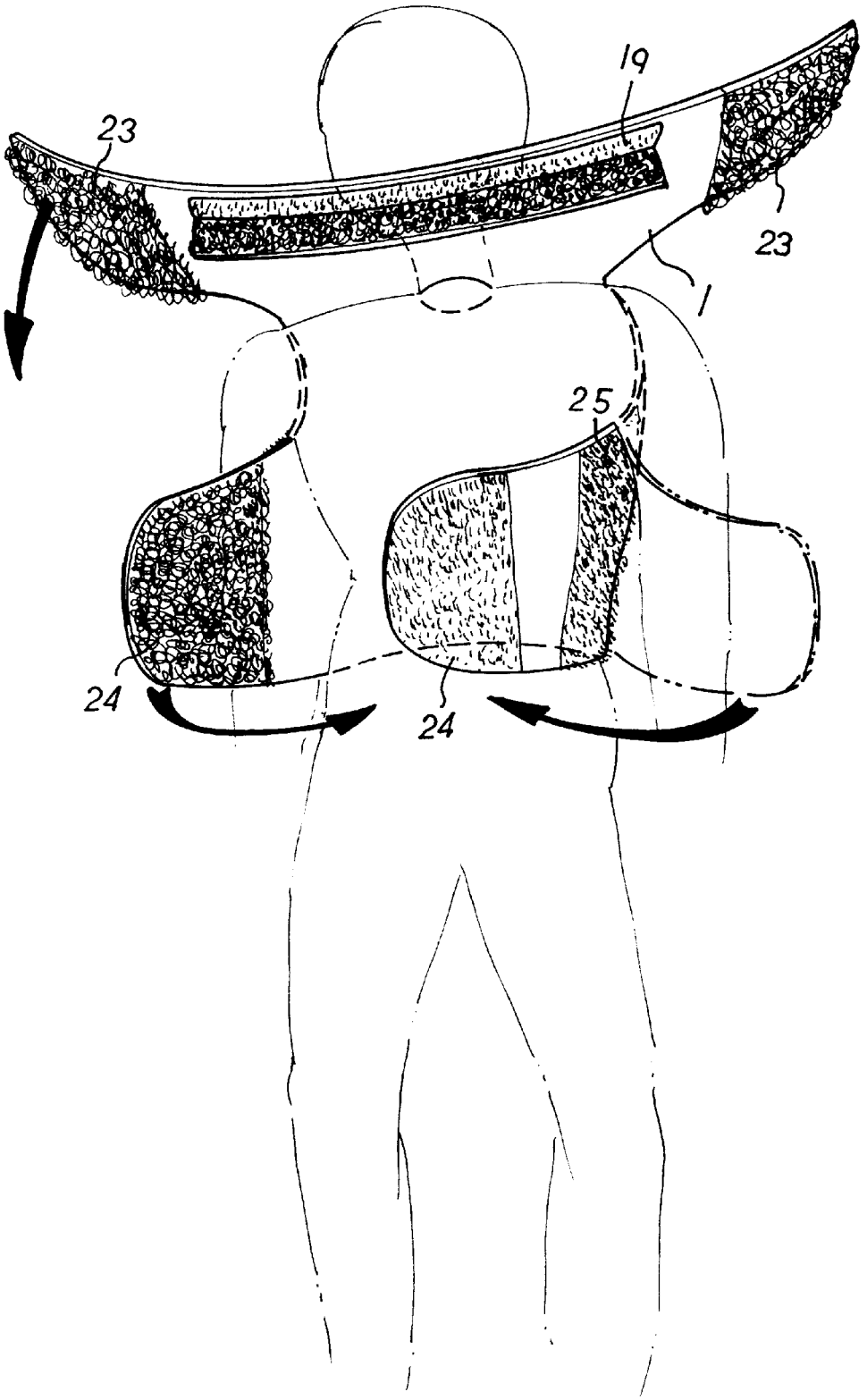
FIG. 15 is a schematic drawing showing the wearing procedure of the vest body according to the present invention.
Figure 16:
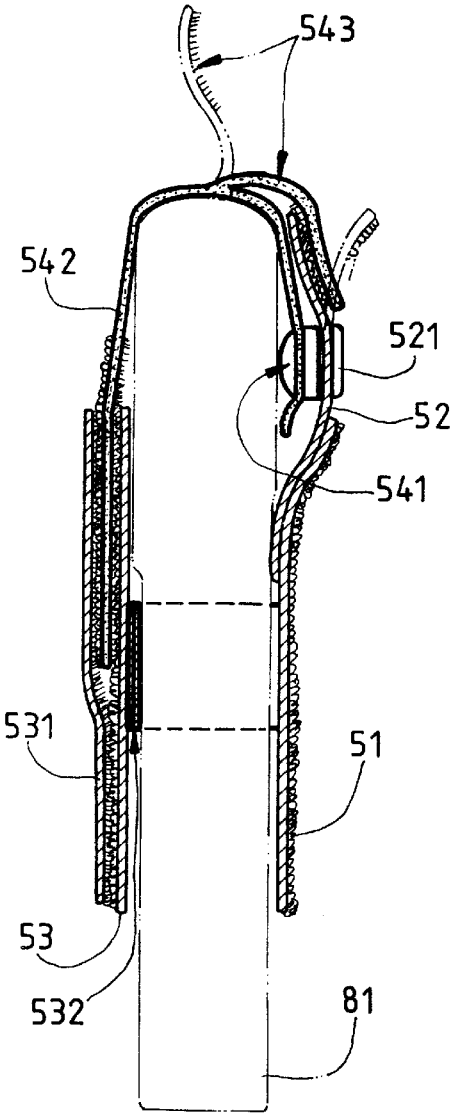
FIG. 16 illustrates the positioning of a pistol in a pistol holder according to the present invention.
Figure 17:
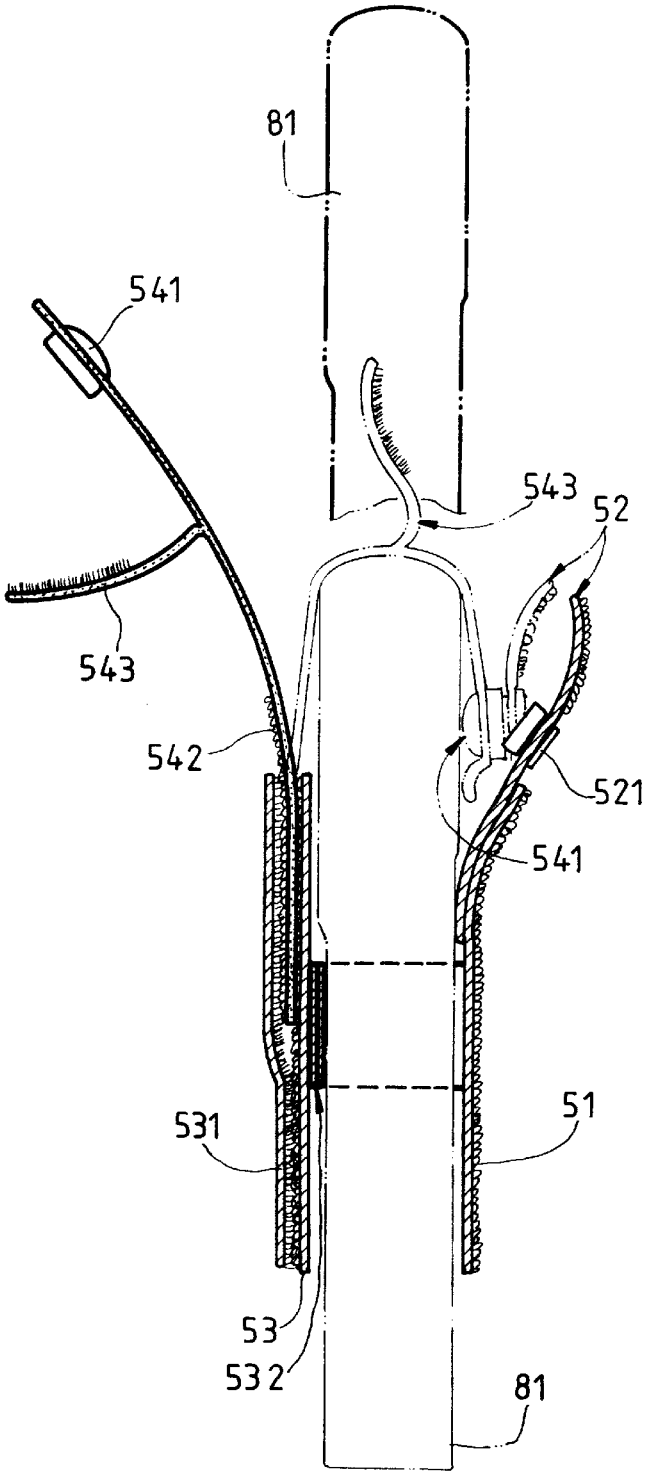
FIG. 17 is similar to FIG. 16 but showing the pistol holder opened.

Referring to FIGS. 14 and 15, when the vest body 1 is put on the body, the second bottom fastening strips 24 are fastened together by hook and loop materials, then the first bottom fastening strips 23 are respectively fastened to the two longitudinal retaining strips 25 by hook and loop materials.

While only one embodiment of the present invention has been shown and described, it will be understood that various modifications and changes could be made thereunto without departing from the spirit and scope of the invention disclosed.

What the invention claimed is:

1. A vest comprising:

a vest body, said vest body having a plurality of locating pads at front and back panels thereof, at least one fixed ammunition pouch at the front panel, a transverse retaining tape at the front panel, and a plurality of fabric fastening strips respectively extended from said locating pads, said fabric fastening strips each having one end fixedly connected to said locating pads and an opposite end detachably fastened to said locating pads by hook and loop materials for securing things to said locating pads;

a plurality of detachable ammunition pouches respectively fastened to said locating pads of said vest body by hook and loop materials, said detachable ammunition pouches each having a plurality of insertion slots for the insertion of said fabric fastening strips;

a name tag detachably fastened to said transverse retaining tape by hook and loop materials;

a pistol holster detachably fastened to one locating pad at the front panel of said jacket body by hook and loop materials to hold a pistol; and a radio transceiver holder detachably fastened to one locating pad at the back panel of said vest body by hook and loop materials to hold a radio transceiver.

2. Vest of claim 1 wherein said fabric fastening strips have a T-shaped profile.

3. The vest of claim 1 wherein said vest body further comprises at a shoulder panel thereof two sets of fixed partition strips arranged at two opposite lateral sides, and two shoulder pads fastened to said partition strips and defining with said partition strips a plurality of insertion holes for receiving the shoulder straps of devices carried by the user, said shoulder pads being arranged at two opposite lateral sides at the shoulder panel of said vest body, each having one end fixed fastened to said vest body and an opposite end detachably secured to said partition strips by hook and loop materials.

4. The vest of claim 1 wherein said at least one detachable ammunition pouch each comprises a pouch body, and a cover flap, said pouch body being fastened to said locating pads of said vest body by hook and loop materials and having a hook tape at a front side thereof and a plurality of insertion slots for the insertion of the fabric fastening strips of said vest body, said cover flap one end fixedly fastened to said pouch body and an opposite end mounted with a loop tape for fastening to the hook tape at said pouch body.

5. The vest of claim 1 wherein said pistol holster comprises a base panel having a plurality of insertion slots for the insertion of the fabric fastening strips at the corresponding locating pad at the front panel of said vest body, a pocket provided at said base panel to hold the pistol, said pocket having a hook tape at a front side thereof an elastic band provided inside said pocket to hold the pistol in place, a cover flap fixedly fastened to one lateral side of said pocket, said cover flap having a loop tape at a free end thereof for fastening to the hook tape of said pocket, a retaining strip having a fixed end fixedly connected to said base panel and a free end, a female snap element at the fixed end of said retaining strip, and a harness detachable connected between said retaining strip and said cover flap to hold down the pistol in said pocket, said harness comprising a first strip, said first strip having a male snap element fastened to the female snap element at the fixed end of said retaining strip and an opposite end detachable retained between said pocket and said cover flap by hook and loop materials, and a second strip raised from a middle part of said first strip and detachably fastened to the free end of said retaining strip by hook and loop materials.

6. The vest of claim 1 wherein said jacket body comprises a pocket on the middle of the front side thereof, a zip fastener operated to close/open the pocket, and a metal plate received in the pocket to the user's heart area against bullets.

7. The vest of claim 1 wherein said vest body further comprises a thigh guard receiver at a bottom side of the front panel thereof, and a thigh guard fastened to said thigh guard receiver to protect the lower part of the user's body.

8. The vest of claim 1 wherein said radio transceiver holder comprises a longitudinal strap, and a transverse strap, said longitudinal strap comprises a loop tape at a back side thereof for fastening to a hook tape at one locating pad at the front panel of said vest body, hook and loop materials longitudinally spaced at a front side thereof, and an elastic band connected with a male fastening element of a quick release hook at a top end thereof, said transverse strap being inserted through a transverse hole near the top end of said longitudinal strap, said transverse strap having a first belt loop at a front end thereof, a hook tape at a front side thereof near a rear end thereof, a loop tape at the front side near the middle, a female fastening element of a quick release hook and a second belt loop spaced between the first hook tape and the second hook tape of said transverse strap and vertically extended in reversed directions, the rear end of said transverse strap being inserted through said first belt loop and then turned back, enabling the hook tape of said transverse strap to be fastened to the loop tape thereof, said longitudinal strap being inserted through said second belt loop and then turned back, enabling the hook tape of the hook and loop materials of said longitudinal strap to be fastened to the loop tape thereof, said male fastening element being fastened to said female fastening element when the radio transceiver is inserted into said radio transceiver receiver.

9. The vest of claim 1 wherein said jacket body further comprises a second transverse retaining tape at the front panel thereof and a retaining flap above said second transverse retaining tape for securing a detachable ammunition pouch by hook and loop materials.

10. The vest of claim 1 wherein said jacket body further comprises a loop at the front panel thereof for hanging a grenade.

11. The vest of claim 1 wherein said vest body further comprises two first bottom fastening strips bilaterally extended from the front panel thereof in reversed directions, and two second bottom fastening strips bilaterally extended from the back panel thereof in reversed directions for connection to said first bottom fastening strips by hook and loop materials to secure said vest body to the user's body, and two longitudinal retaining strips bilaterally disposed at the back panel thereof for securing said first bottom fastening strips by hook and loop materials.

* * * * *